US008851627B2

(12) United States Patent
Harada

(10) Patent No.: US 8,851,627 B2
(45) Date of Patent: Oct. 7, 2014

(54) LIQUID EJECTING APPARATUS

(71) Applicant: Seiko Epson Corporation, Tokyo (JP)

(72) Inventor: Shuhei Harada, Chino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/850,927

(22) Filed: Mar. 26, 2013

(65) Prior Publication Data

US 2013/0307900 A1 Nov. 21, 2013

(30) Foreign Application Priority Data

May 16, 2012 (JP) ..... 2012-112214

(51) Int. Cl.
*B41J 2/165* (2006.01)

(52) U.S. Cl.
CPC ..... *B41J 2/16511* (2013.01); *B41J 2/16585* (2013.01); *B41J 2/16547* (2013.01)
USPC ..... 347/32

(58) Field of Classification Search
CPC ..... B41J 2/16547
USPC ..... 347/32
See application file for complete search history.

(56) References Cited

U.S. PATENT DOCUMENTS

| | | | | |
|---|---|---|---|---|
| 6,578,949 | B2 * | 6/2003 | Takahashi et al. | 347/30 |
| 6,637,857 | B2 * | 10/2003 | Shimizu et al. | 347/32 |
| 2009/0002448 | A1 | 1/2009 | Hosono et al. | |
| 2011/0279530 | A1 | 11/2011 | Love et al. | |

FOREIGN PATENT DOCUMENTS

| | | |
|---|---|---|
| JP | 2003-534165 | 11/2003 |
| JP | 2009-006681 | 1/2009 |
| WO | 01-89836 | 11/2001 |

* cited by examiner

*Primary Examiner* — Stephen Meier
*Assistant Examiner* — Alexander D Shenderov
(74) *Attorney, Agent, or Firm* — Workman Nydegger

(57) ABSTRACT

A liquid ejecting apparatus includes a recording head ejecting ink onto a paper; a tray which moves in a direction along a nozzle forming surface in a state where a plurality of units are displaceably supported in a direction approaching and separating from the nozzle forming surface of the recording head; and a cam which is disposed on a moving path of the tray and engages individually with at least two units while the tray moves in a direction along the nozzle forming surface, and makes the units engage individually to be displaced in the direction approaching and separating from the nozzle forming surface.

10 Claims, 6 Drawing Sheets

LIQUID EJECTING APPARATUS

BACKGROUND

1. Technical Field

The present invention relates to a liquid ejecting apparatus including a plurality of functional members which has a functional member maintaining a liquid ejecting head.

2. Related Art

In the related art, as a liquid ejecting apparatus ejecting a liquid to a target, an ink jet type printer has been known widely in which recording is performed on a paper (a target) by ejecting an ink (a liquid) from a nozzle formed on a liquid ejecting head. In such a printer, there has been a line printer in which an elongated line head is disposed on a transportation path of a paper across a width direction of the paper. Since the line printer performs the print by one line unit while continuously transporting the paper, it is possible to print in high speed, unlike a serial printer which prints by a letter unit or a dot unit while intermittently transporting the paper.

However, the line printer is difficult to provide a maintenance region outside a printing region compared to the serial printer. In addition, generally, a maintenance mechanism including a plurality of functional members which has a functional member maintaining the line head is disposed on a position facing the line head.

For example, in JP-T-2003-534165, a printer is disclosed, which is the line printer including such a maintenance mechanism and in which a functional members such as a support member (a platen surface), a cap (a capping device) and an ink absorption material (an absorbing device) are disposed side by side in a circumferential direction on a peripheral surface of a substantially cylindrical support member body (a platen body) disposed on a position facing the line head.

In addition, in JP-A-2009-6681, a printer is disclosed in which a support member (a platen) having a concave section which is also an ink receiving section (an ink accepting section) is disposed on a position facing the line head and a cap (a sealing member) is provided inside the ink receiving section.

However, in a case of the constitution disclosed in JP-T-2003-534165, the support member body is rotated when switching the functional member from the functional members configured to include the support member, the cap and the ink absorption material, which functions in the position facing the line head. Thus, design has to take into account the radius of rotation thereof so that it is difficult to reduce the size of the apparatus.

In addition, the printer disclosed in JP-A-2009-6681 is constituted such that the line head itself can be moved to abut the cap. There is a concern that the apparatus becomes larger when a region, in which the line head is moved, is secured having a width larger than a width of a paper.

In addition, such a situation is substantially common in a liquid ejecting apparatus including a plurality of functional members having a functional member which maintains the liquid ejecting head as well as the ink jet type printer described above.

SUMMARY

An advantage of some aspects of the invention is to provide a liquid ejecting apparatus, in which a functional member, which functions with respect to a liquid ejecting head when maintaining the liquid ejecting head, from a plurality of functional members including a functional member maintaining a liquid ejecting head can be switched while suppressing increase in the size of the apparatus.

According to an aspect of the invention, there is provided a liquid ejecting apparatus including: a liquid ejecting head ejecting liquid from a nozzle formed on a nozzle forming surface onto a target; a moving body which moves in a direction along the nozzle forming surface in a state where a plurality of functional members including a functional member maintaining the liquid ejecting head is displaceably supported in a direction approaching and separating from the nozzle forming surface; a driving mechanism which is driven when the moving body is moved; and a cam which is disposed on a moving path of the moving body and engages with at least two of the plurality of functional members, individually, supported on the moving body while the moving body moves in the direction along the nozzle forming surface, and makes the functional members to be displaced in the direction approaching and separating from the nozzle forming surface.

In this case, when the moving body supporting the plurality of the functional members moves in the direction along the nozzle forming surface of the liquid ejecting head according to the driving of the driving mechanism, at least two functional members of the plurality of the functional members engage with the cam, individually. Then, at that time, the functional member engaged with the cam, individually is displaced in the direction approaching and separating from the nozzle forming surface so as to function with respect to the liquid ejecting head. In other words, the moving body moves in the direction along the nozzle forming surface with the driving force from the driving mechanism, and, at the same time, at least two functional members are engaged with the cam to be displaced sequentially and individually, and the functional member functioning with respect to the liquid ejecting head is switched sequentially. Accordingly, the functional member from the plurality of functional members including the functional member which maintains the liquid ejecting head, and which functions with respect to the liquid ejecting head, can be switched while reducing the size of the apparatus.

In the liquid ejecting apparatus, the plurality of the functional members may include at least one of a wiper unit capable of wiping the liquid from the nozzle forming surface by sliding on the nozzle forming surface on which the liquid is attached and a cap unit capable of forming a closed space by abutting the liquid ejecting head so as to surround the nozzle, and a support unit capable of supporting the target so that the target faces the nozzle forming surface when the liquid is ejected from the nozzle of the liquid ejecting head onto the target.

In this case, since at least one of the wiper unit and the cap unit, which maintains the liquid ejecting head, and the support unit that has the support function of the target engage with the cam, sequentially and independently while the moving body is moved with the driving of the driving mechanism, the functional member functioning with respect to the liquid ejecting head can be simply switched.

In the liquid ejecting apparatus, the cam may have a first cam surface which makes at least two functional members engaged with the cam to be displaced, individually, in the direction approaching to the nozzle forming surface, while the moving body moves in the direction along the nozzle forming surface, and a second cam surface which makes at least two functional members to be displaced, individually, in the direction separating from the nozzle forming surface.

In this case, the functional member can be displaced in the direction approaching and separating from the nozzle forming surface by moving in one direction without reciprocating the moving body.

In the liquid ejecting apparatus, a distance in which the moving body is moved from where the engagement of one of at least two of the functional members with the cam is started to where the engagement of the other of at least two of the functional members with the cam is started, may be longer than a distance in which the moving body is moved from where the engagement of the one functional member with the cam is started to where the engagement thereof is finished, when the moving body moves in the direction along the nozzle forming surface.

In this case, since other functional members do not engage with the cam in a state where one unit engages with the cam, it is possible to suppress the interference on each other by approaching the nozzle forming surface while engaging the plurality of the functional members with the cam together.

In the liquid ejecting apparatus, the moving body may include a guide groove which is moved when the functional member is displaced in the direction approaching and separating from the nozzle forming surface, and the functional member may be constituted such that a center-of-gravity position thereof in a sliding direction of a sliding section which slides in the guide groove is positioned inside the guide groove, in a state where the functional member is the closest to the nozzle forming surface by engaging with the cam individually.

In this case, although the functional members engaging with the cam are in the closest state to the nozzle forming surface, the center-of-gravity positions in the sliding direction of the sliding section which slides in the guide groove of the moving body in the functional member fall inside the guide groove. Thus, it is possible to suppress that the functional member is separated (in other words, the supporting state by the moving body is released) from the moving body.

In the liquid ejecting apparatus, the plurality of the functional members may be the wiper unit, the support unit and the cap unit, and the moving body may support the wiper unit, the support unit and the cap unit so that a disposition order engaging with the cam is provided in the order of the wiper unit, the support unit and the cap unit when the moving body moves in the direction along the nozzle forming surface.

In the liquid ejecting apparatus, the plurality of the functional members may be the wiper unit, the support unit and the cap unit, and the moving body may support the wiper unit, the support unit and the cap unit so that a disposition order engaging with the cam is provided in the order of the support unit, the cap unit and the wiper unit when the moving body moves in the direction along the nozzle forming surface.

In the liquid ejecting apparatus, the plurality of the functional members may be the wiper unit, the support unit and the cap unit, and the moving body may support the wiper unit, the support unit and the cap unit so that a disposition order engaging with the cam is provided in the order of the cap unit, the wiper unit and the support unit when the moving body moves in the direction along the nozzle forming surface.

In this case, since the disposition order of the wiper unit, the support unit and the cap unit supported by the moving body can be freely selected, the degree of freedom in design can be increased. In addition, while the liquid ejecting apparatus is used, if each of the wiper unit, the support unit and the cap unit is detachably supported with respect to the moving body, the disposition order of the wiper unit, the support unit and the cap unit supported by the moving body can be freely changed.

In the liquid ejecting apparatus, the plurality of the functional members may include the wiper unit capable of wiping the liquid from the nozzle forming surface by sliding on the nozzle forming surface on which the liquid is attached in the liquid ejecting head, and wherein when the cam is a first cam, the liquid ejecting apparatus may further include a wiper cleaner which absorbs the liquid attached to the wiper unit by wiping the liquid ejecting head by the wiper unit, and a second cam which makes the wiper unit to be displaced in the direction approaching and separating from the wiper cleaner when the moving body moves in the direction along the nozzle forming surface.

In this case, the liquid attached to the wiper unit can be removed by approaching (abutting) to the wiper cleaner by the second cam without leaving the ink attached to the wiper unit which wipes the nozzle forming surface of the liquid ejecting head. Accordingly, it is possible to suppress the degradation of the wiping performance of the wiper unit due to fixing of the liquid in the wiper unit.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of an ink jet type printer (hereinafter, simply referred to as "a printer") embodying the invention that is a type of a liquid ejecting apparatus will be described with reference to the drawings.

Figure 1:
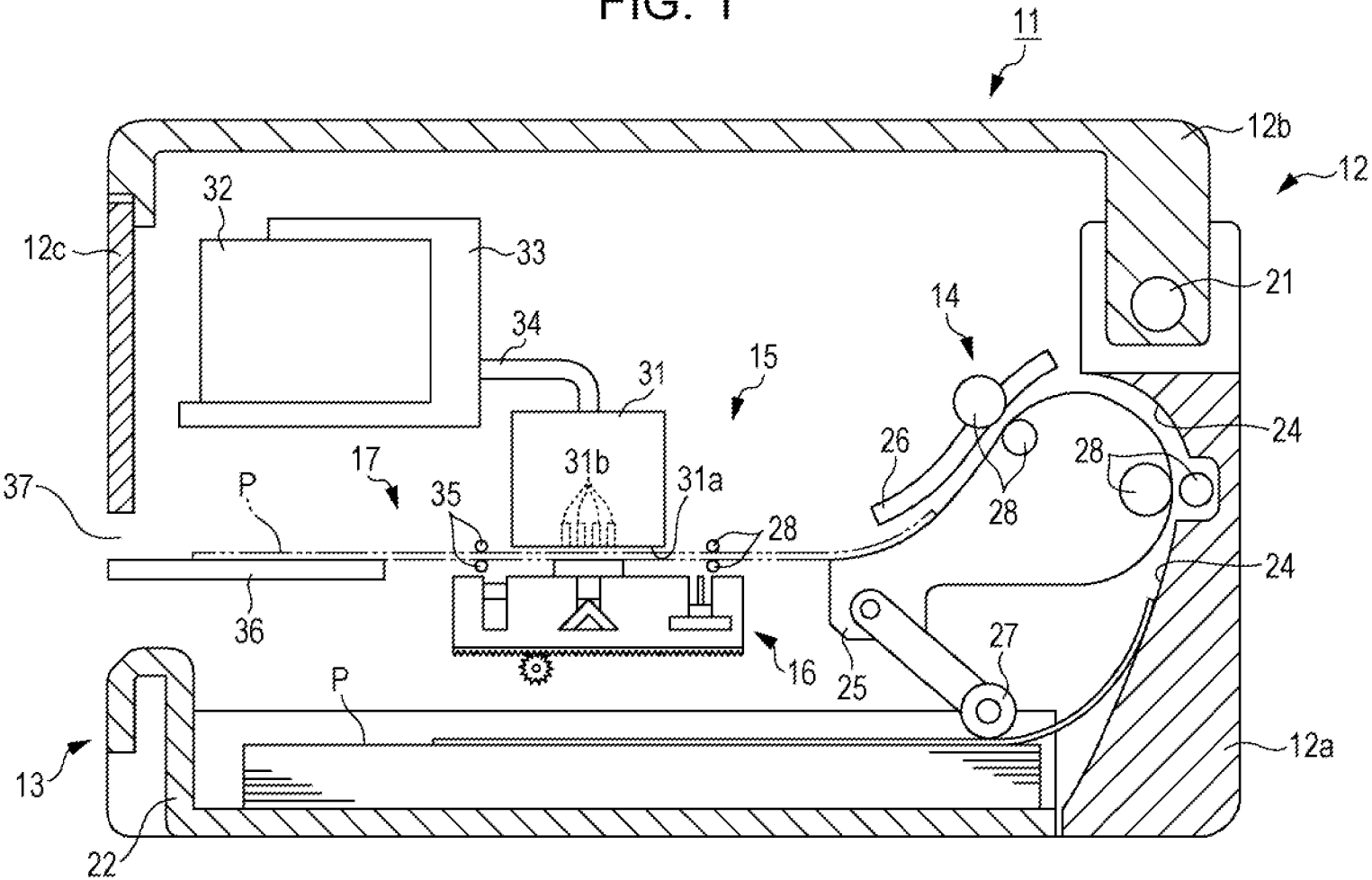
FIG. 1 is a schematic front cross-sectional view of a printer according to an embodiment of the invention.

As illustrated in FIG. 1, a printer 11 of the embodiment includes an installing section 13, a transportation section 14, a recording section 15, a functional section 16 and a discharging section 17 inside a frame 12 that is a case. In addition, they are sequentially disposed along a transportation path of a paper P as a target on which a recording is performed by ejecting of ink (liquid) in the printer 11. In addition, the frame 12 is constituted of a lower case (an apparatus body) 12*a* including the installing section 13, the transportation section 14, the functional section 16 and the discharging section 17, and an upper case 12*b* including the recording section 15. Here, the upper case 12*b* is pivoted rotatably about a support shaft 21 with respect to the lower case 12*a*. In addition, the upper case 12*b* can take a position in which an interior of the lower case 12*a* is covered to block from the outside and a position in which the interior of the lower case 12*a* is open to the outside.

Hereinafter, the constitution of the printer 11 along a transportation path of the paper P is described.

As illustrated in FIG. 1, a paper feeding cassette 22 in which a plurality of the papers P are stocked is disposed in the installing section 13 which is positioned uppermost upstream in the transportation path of the paper P. The paper feeding cassette 22 can be inserted or removed in a direction (a right-left direction in FIG. 1) orthogonal to a stocking direction of the paper P. Then, the transportation section 14 positioned downstream the installing section 13 in the transportation path transports the paper P stocked and stored in the paper feeding cassette 22 to the recording section 15 by one sheet using a paper feeding roller 27 pivoted swingably in a transportation-path forming member 25.

In addition, the transportation path is consisted of a reverse transportation path in which the transportation direction of the paper P is reversed in the transportation section 14. In other words, the paper P delivered from the paper feeding cassette 22 is transported in a rear end of the paper feeding cassette 22 in an inserting direction along an inclined surface 24 formed in an inner surface of the lower case 12*a*. After that, the paper P is reversed by the transportation path having a curved shape and is transported toward the recording section 15 on the transportation path formed between the transportation-path forming member 25 and a regulating member 26. In addition, a plurality of transportation roller pairs 28 are included in the transportation path of the transportation section 14 to feed the paper P toward the recording section 15 side.

Furthermore, the recording section 15 and the functional section 16 are disposed downstream the transportation section 14 across the transportation path of the paper P, respectively. The recording section 15 performing the recording on the paper P includes a recording head 31 (a liquid ejecting head), an ink cartridge 32 supplying the ink to the recording head 31 and a cartridge holder 33 capable of installing and detaching the ink cartridge 32. The recording head 31 is a so-called line head type recording head 31 of which an entire shape is formed to be longer than a width dimension of the paper P in a width direction orthogonal to the transportation direction of the paper P. Then, a surface in the recording head 31 facing the paper P is consisted of a nozzle forming surface 31*a* on which a plurality of nozzle rows (four rows as an example in the embodiment) consisted of a plurality of nozzles 31*b* ejecting the ink (the liquid).

In addition, one end of an ink supply path 34 is connected to one surface (an upper surface in FIG. 1) of the recording head 31 and the other end of the ink supply path 34 is connected to the ink cartridge 32 via the cartridge holder 33. In addition, the recording head 31 and the cartridge holder 33 are disposed to be fixed to the inner portion of the upper case 12*b*.

In addition, a front cover 12*c* is provided which is openable with respect to the upper case 12*b* in an extracting direction of the paper feeding cassette 22 viewed from the ink cartridge 32. The ink cartridge 32 can be disposed and detached with respect to the cartridge holder 33 in a state where the front cover 12*c* is open.

The discharging section 17, which discharges the recorded paper P to outside the printer 11, is provided downstream the recording section 15 and the functional section 16. The discharging section 17 includes sequentially a discharging roller pair 35, a discharged-paper stand 36 and a discharging port 37 in a direction from the functional section 16 to outside the printer 11 along the transportation path of the paper P.

Figure 2A:
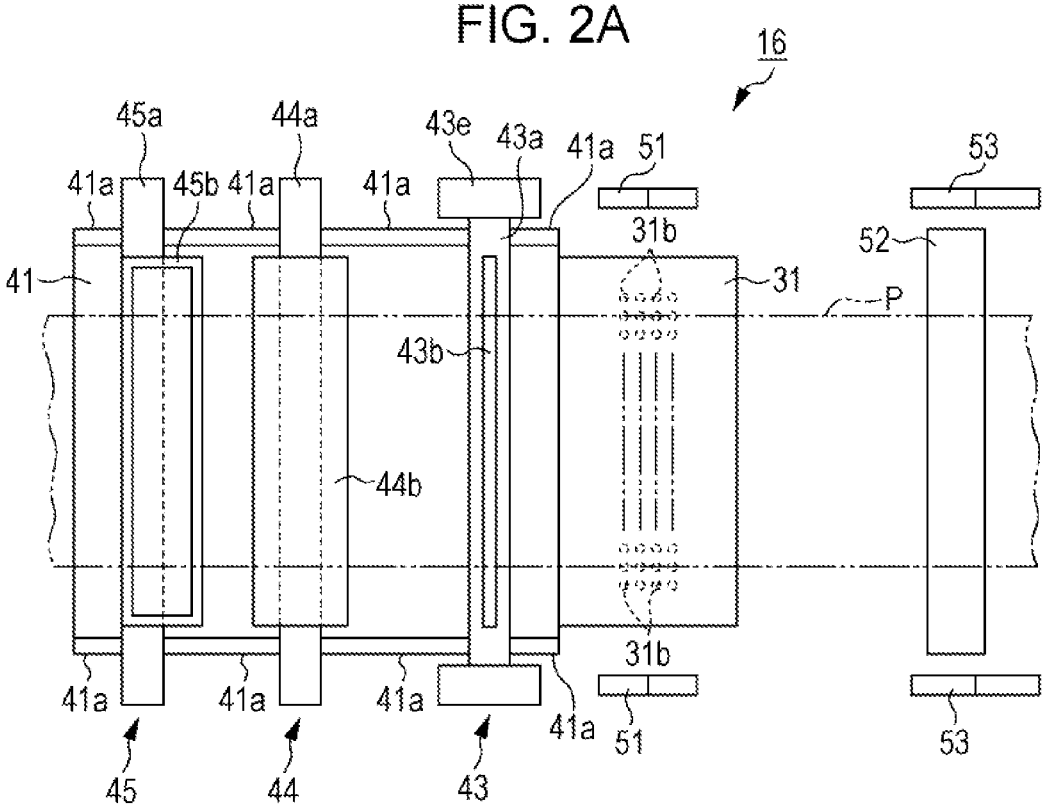
FIG. 2A is a schematic plan view illustrating a functional section and FIG. 2B is a schematic front view illustrating the functional section.
Figure 2B:
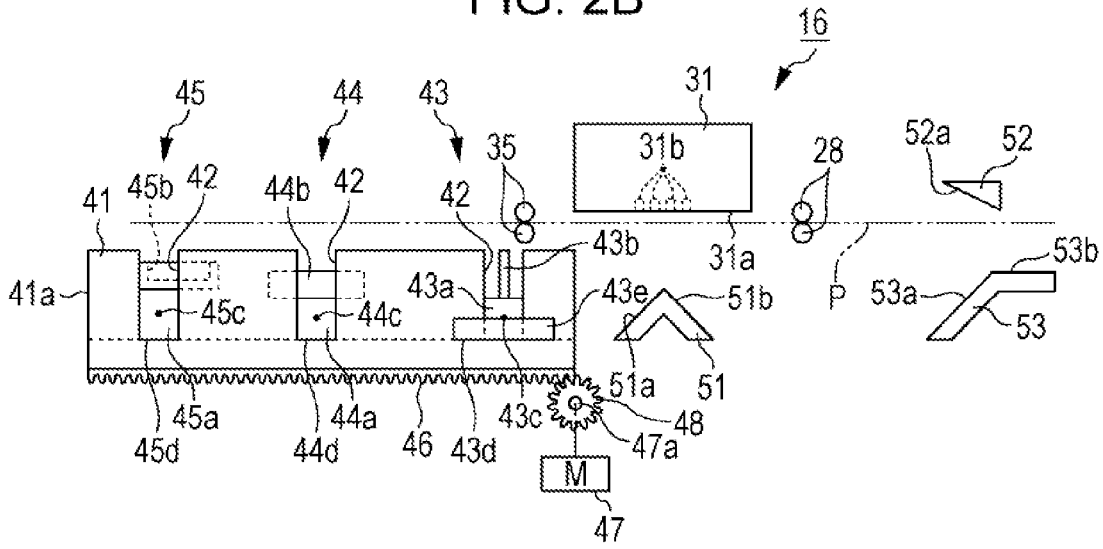

Next, the functional section 16 is described in detail which supports the paper P when the paper P is recorded and when the paper P is transported, and maintains the nozzle forming surface 31*a* of the recording head 31 with reference to FIGS. 2A and 2B. In addition, the right side is referred to as upstream and the left side is referred to as downstream following the transportation direction of the paper P in the drawings after FIGS. 2A and 2B.

As illustrated in FIGS. 2A and 2B, the functional section 16 includes a tray (a moving body) 41 having a substantially rectangular shape in a plan view in a thickness direction (a direction orthogonal to the paper surface in FIG. 2A and a vertical direction in FIG. 2B) of the paper P. A pair of side walls 41*a* is provided on both ends of the tray 41 in the width direction of the paper P along the transportation direction of the paper P. Three guide grooves 42, which are disposed in the same interval in the transportation direction of the paper P, are cut from the upper end of each of side walls 41*a* to the lower side thereof to be formed on the both side walls 41*a* thereof.

A wiper unit 43, a support unit 44 and a cap unit 45 are disposed in each of the guide grooves 42. Each of units (the functional members) 43 to 45 includes quadrangular prism-shaped sliding shafts (sliding sections) 43*a* to 45*a* extending longer than the width of the tray 41 in the width direction of the paper P. Each of the sliding shafts 43*a* to 45*a* is slidably supported in the guide groove 42 of the tray 41. In addition, center-of-gravity positions of the sliding shafts 43*a* to 45*a* in a moving direction of the tray 41 and in the sliding direction of each of the units 43 to 45 with respect to the tray 41 are illustrated as center-of-gravity positions 43*c* to 45*c* in FIG. 2B.

In the wiper unit 43, a wiper blade 43*b* wiping the ink attached to the nozzle forming surface 31*a* of the recording head 31 is erected on a surface in the sliding shaft 43*a* facing the recording head 31 so as to extend toward the nozzle forming surface 31*a*. The wiper blade 43*b* is formed in a strip shape of which the longitudinal direction is the width direction of the paper P. The length thereof in the longitudinal direction is longer than the nozzle row of the nozzles 31*b* of the recording head 31 so that the entire the nozzle forming surface 31*a* can be wiped by wiping operation by one time. In addition, it is preferable that a material of the wiper blade 43*b* be rubber or resin having elasticity so that the nozzle forming surface 31*a* is not damaged when the wiper blade 43*b* wipes the nozzle forming surface 31*a* of the recording head 31.

The support unit 44 has a support stand 44*b* supporting the paper P on a surface in the sliding shaft 44*a* facing the recording head 31. The support stand 44*b* supports the paper P when the recording head 31 ejects the ink onto the paper P. The support stand 44*b* has a rectangular shape of which the longitudinal direction is the width direction of the paper P in a plan view in the thickness direction of the paper P and the length thereof in the longitudinal direction is longer than the width of the maximum paper printable in the printer 11.

The cap unit 45 includes a cap 45*b* on a surface in the sliding shaft 45*a* facing the recording head 31. The cap 45*b* abuts the nozzle forming surface 31*a* so as to surround the nozzles 31*b* of the recording head 31. The cap 45*b* has a rectangular box shape of which the longitudinal direction is the width direction of the paper P in a plan view in the thickness direction of the paper P and the opening shape thereof is slightly larger than a region on which the nozzles 31*b* are formed in the nozzle forming surface 31*a* of the recording head 31.

In addition, a rack 46 is formed on a surface in the tray 41 opposite (the lower side in FIG. 2B) to a surface facing the recording head 31 so as to extend along the transportation direction of the paper P. The rack 46 meshes with a pinion 48 supported on the lower case 12*a* so as to rotate around a shaft 47*a*, based on a driving force of a driving motor 47. In other words, the rack 46 mashing with the pinion 48 which is rotated by driving of the driving motor 47 in forward and backward rotation can reciprocate in a direction (a direction along the transportation direction of the paper P) along the nozzle forming surface 31*a* of the recording head 31 and also can reciprocate with respect to the tray 41 on which the rack 46 is formed. Accordingly, the rack 46, the driving motor 47 and the pinion constitute a driving mechanism which moves the tray 41.

As illustrated in FIGS. 2A and 2B, a pair of first cams 51 is disposed on a position outside the recording head 31 in the longitudinal direction, which is a position outside the moving region of the tray 41. The first cams 51 moves each of units 43 to 45 in a direction approaching and separating from the nozzle forming surface 31*a* by engaging with the sliding shafts 43*a* to 45*a* of each of units 43 to 45 supported on the tray 41 thereof while the tray 41 is moved. In addition, in a case of the wiper unit 43, a sliding plate section 43*e* having a rectangular plate shape which is integrally formed as a portion of the both end portions of the sliding shaft 43*a* thereof engages with the first cams 51. In addition, each of units 43 to 45 is supported on the tray 41 with a disposition order engaging with the first cams 51 in the order of the wiper unit 43, the support unit 44 and the cap unit 45 when the tray 41 moves from downstream toward upstream in a state of being illustrated in FIGS. 2A and 2B.

As illustrated in FIG. 2B, the first cams 51 has a first cam surface 51*a* which is formed having an upward slope so as to approach to the nozzle forming surface 31*a* of the recording head 31 from the downstream side to the upstream side and a second cam surface 51*b* which is formed having a downward slope so as to separate from the nozzle forming surface 31*a* from the downstream side to the upstream side. In other words, when the tray 41 moves so as to pass through the position, in which the first cams 51 are disposed, from the downstream side to the upstream side, the first cam surface 51*a* moves each of units 43 to 45 to the direction approaching to the nozzle forming surface 31*a* and the second cam surface 51*b* moves each of units 43 to 45 to the direction separating from the nozzle forming surface 31*a*.

In addition, in the sliding shafts 43*a* to 45*a* of each of units 43 to 45, a portion that is a surface opposite to the surface having the wiper blade 43*b*, the support stand 44*b* and the cap 45*b*, that is, a portion protruding outside from the moving region of the tray 41 in the width direction of the paper P functions as engagement surfaces 43*d* to 45*d* engaging or sliding on the first cams 51. In order to wipe the nozzle forming surface 31*a* of the recording head 31, the wiper unit 43 includes the engagement surface 43*d* longer than other units 44 and 45 because the wiper unit 43 is necessary to engage with the first cams 51 through a long distance in the moving direction of the tray 41 compared to the other units 44 and 45. Accordingly, the engagement surface 43*d* is constituted of a lower surface of the sliding plate section 43*e* integrally formed with the both end portions of the sliding shaft 43*a*.

In FIGS. 2A and 2B, a wiper cleaner 52 is disposed upstream viewed from the recording head 31. The wiper cleaner 52 abuts the wiper blade 43*b* to absorb and remove the ink attached to the wiper blade 43*b* when wiping the nozzle forming surface 31*a* of the recording head 31. The wiper cleaner 52 is formed in a triangular prism shape and is disposed so that an abutting surface 52*a* thereof abutting the wiper blade 43*b* has an angle with respect to a direction along the nozzle forming surface 31*a* of the recording head 31. In addition, the length of the wiper cleaner 52 in the longitudinal direction has a length which can abut the entire region of the wiper blade 43*b* in the longitudinal direction. In addition, it is preferable that the wiper cleaner 52 be made by a material having a high ability to absorb and holding the ink such as porous material or pulp.

In FIGS. 2A and 2B, a second cam 53 is disposed on a position upstream viewed from the first cams 51. The second cam 53 moves the wiper unit 43 in a direction approaching and separating from the wiper cleaner 52 by engaging with the engagement surface 43*d* of the wiper unit 43 supported on the tray 41. The second cam 53 has a third cam surface 53*a* formed having an upward slope so as to approach to the wiper cleaner 52 from the downstream side to the upstream side and a fourth cam surface 53*b* formed in a direction along the nozzle forming surface 31*a*. The third cam surface 53*a* moves the wiper unit 43 in a direction approaching and separating from the wiper cleaner 52 along the moving direction of the tray 41 by engaging with the engagement surface 43*d* of the wiper unit 43. Meanwhile, the fourth cam surface 53*b* engages with the engagement surface 43*d* of the wiper unit 43 but the wiper unit 43 does not move in the direction approaching and separating from the wiper cleaner 52 on the fourth cam surface 53*b*.

In addition, a distance between the wiper cleaner 52 and the second cam 53 in the thickness direction of the paper P is set to be shorter than a distance between the nozzle forming surface 31*a* of the recording head 31 and the first cams 51.

Next, operation of the printer 11 constituted as described above, is described by focusing on the positional relationship between each of units 43 to 45 supported by the tray 41 and each of the cams 51 and 53.

Now, when printing on the paper P, the tray 41 supporting the support unit 44 is moved so that the support stand 44*b* is disposed on the position facing the nozzle forming surface 31*a* of the recording head 31. For example, when the tray 41 is in a state illustrated in FIGS. 2A and 2B that is in the lowermost position on the moving region thereof, the pinion 48 is rotated forward (rotate in a clockwise direction in FIG. 2B) by the driving motor 47 and the tray 41 is moved upstream with the rack 46 meshing with the pinion 48. Then, first, the engagement surface 43*d* of the wiper unit 43 engages with the first cams 51 and the wiper unit 43 passes through the position of the first cams 51 from the downstream side to the upstream side while being displaced in a direction approaching and separating from the nozzle forming surface 31*a* of the recording head 31. In addition, at this time, when the recording head 31 is moved upwards, it is possible to avoid the nozzle forming surface 31*a* of the recording head 31 being wiped by the wiper blade 43*b* of the wiper unit 43.

Then, when the tray 41 moves upstream from the state described above, next, the sliding shaft 44*a* of the support unit 44 engages with the first cams 51. Specifically, the engaging surface 44*d* abuts the first cam surface 51*a* on the sliding shaft 44*a* of the support unit 44. Furthermore, the engaging surface 44*d* starts to slide with respect to the first cam surface 51*a* and then the support unit 44 moves in a direction approaching the nozzle forming surface 31*a* relative to the tray 41 moving upstream.

Figure 3:
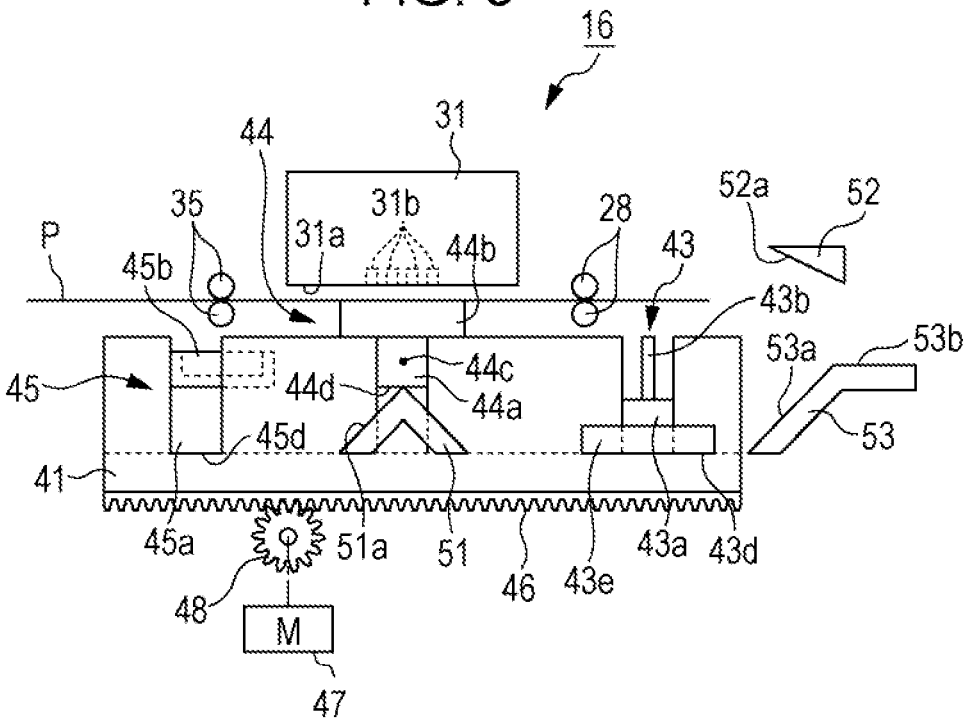
FIG. 3 is a schematic front view of the functional section when a support unit engages with a first cam.

FIG. 3 illustrates that the support unit 44 and the support stand 44*b* included in the support unit 44 are disposed closest to the nozzle forming surface 31*a* of the recording head 31. The support stand 44*b* is disposed as described above and then the printer 11 is capable of performing the recording on the paper P. In other words, the papers P stocked and arranged in the installing section 13 are transported to the recording section 15 by the transportation section 14 by one sheet and the ink is ejected from the recording section 15 (the nozzles 31*b* of the recording head 31) toward the paper P supported on the functional section 16 (the support stand 44*b*).

In addition, in the recording head 31 of the printer 11, if there is the nozzles 31*b* from which the ink is not ejected over a long time, the cleaning for removing the ink thickened in the nozzles 31*b* or air bubbles in the ink is performed. Hereinafter, operation of the functional section 16 is described when performing the cleaning.

The cleaning of the nozzles 31*b* of the recording head 31 is performed in a state where the cap 45*b* of the cap unit 45 abuts the nozzle forming surface 31*a* of the recording head 31 so as to surround the nozzles 31*b*. Thus, first, in order to face the nozzle forming surface 31*a* and the cap 45*b*, the tray 41 is moved by the driving of the driving motor 47.

Figure 4:
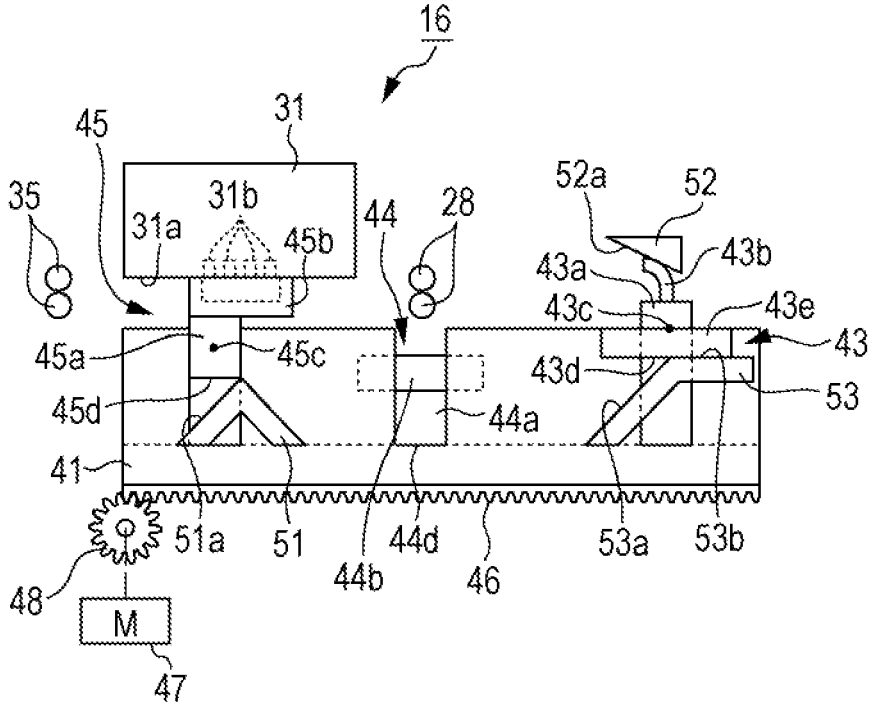
FIG. 4 is a schematic front view of the functional section when a cap unit engages with the first cam.

FIG. 4 illustrates a state where the cap 45*b* included in the cap unit 45 abuts the nozzle forming surface 31*a* of the recording head 31 by moving the tray 41 to the uppermost of the moving region and by engaging the engaging surface 45*d* of the cap unit 45 with the first cams 51. Then, the ink in the nozzles 31*b* of the recording head 31 is discharged inside the cap 45*b* by generating a negative pressure inside the cap 45*b* in the abutted state. In addition, the thickened ink or the air bubbles in the ink are removed in the nozzles 31*b*.

However, when performing the cleaning described above, since the ink is attached to the nozzle forming surface 31*a* of the recording head 31, subsequently, the nozzle forming surface 31*a* is wiped by the wiper unit 43 in order to remove the ink attached to the nozzle forming surface 31*a*. Hereinafter, wiping operation of the nozzle forming surface 31*a* by the wiper unit 43 is described.

Figure 5:
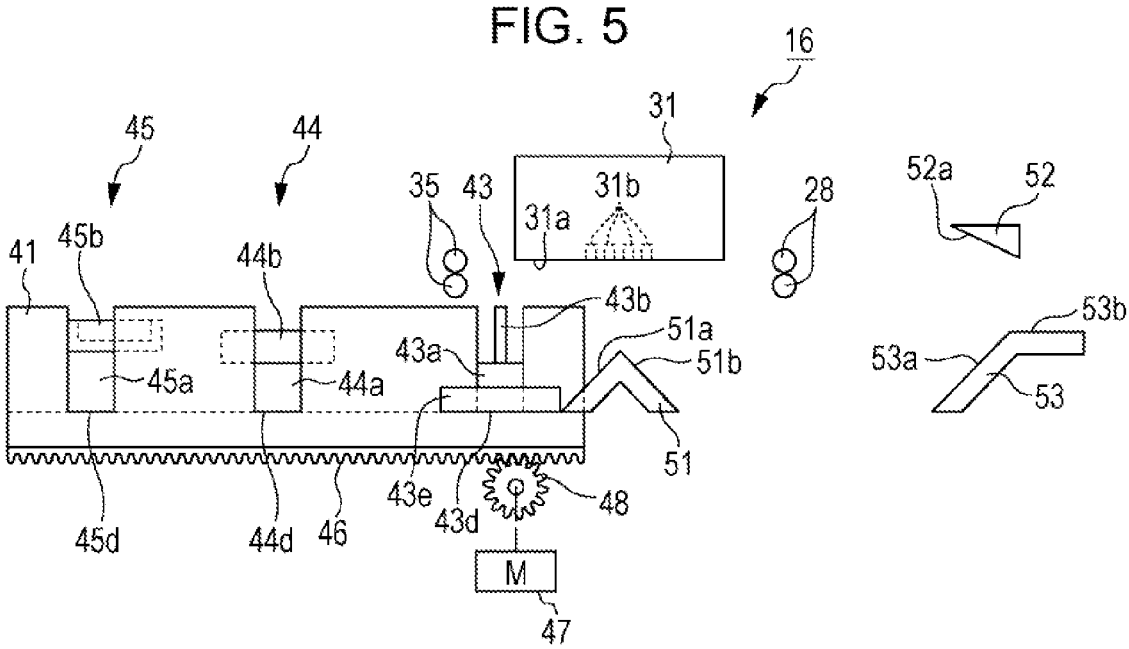
FIG. 5 is a schematic front view of the functional section immediately before a wiper unit engages with the first cam.

FIG. 5 illustrates a position immediately before the engagement of the wiper unit 43 with the first cams 51 is started. The illustrated disposition is obtained by moving the tray 41 downstream by driving the driving motor 47 after the cleaning of the recording head 31 is finished by the cap unit 45. Then, the first cam surface 51*a* of the first cams 51 and the engagement surface 43*d* of the wiper unit 43 slide to each other, and the wiper unit 43 moves in a direction approaching the nozzle forming surface 31*a* relative to the tray 41 by moving the tray 41 upstream from the position illustrated FIG. 5.

Figure 6:
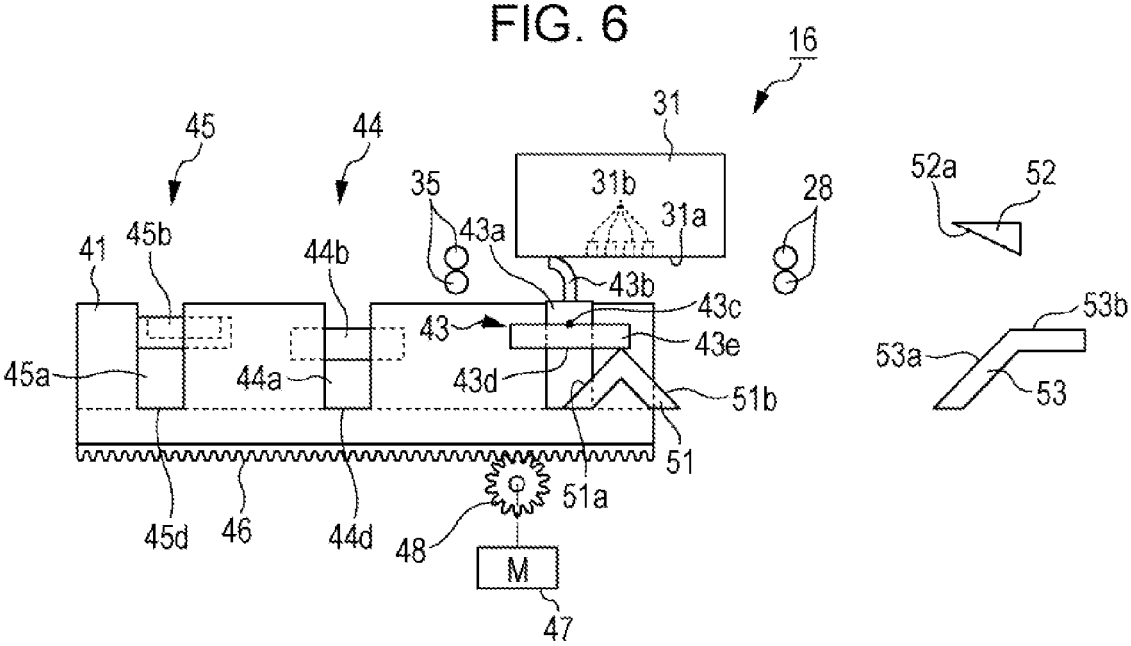
FIG. 6 is a schematic front view of the functional section when the wiper unit is the closest to a nozzle forming surface.

FIG. 6 illustrates a state when the wiper unit 43 approaches the closest nozzle forming surface 31*a* of the recording head 31. In this state, the wiper blade 43*b* included in the wiper unit 43 abuts the nozzle forming surface 31*a* in a state of being elastically deformed. Then, the wiper blade 43*b* wipes the nozzle forming surface 31*a* of the recording head 31 and the ink attached to the nozzle forming surface 31*a* is removed by moving the tray 41 further upstream from the state being illustrated in FIG. 6.

Figure 7:
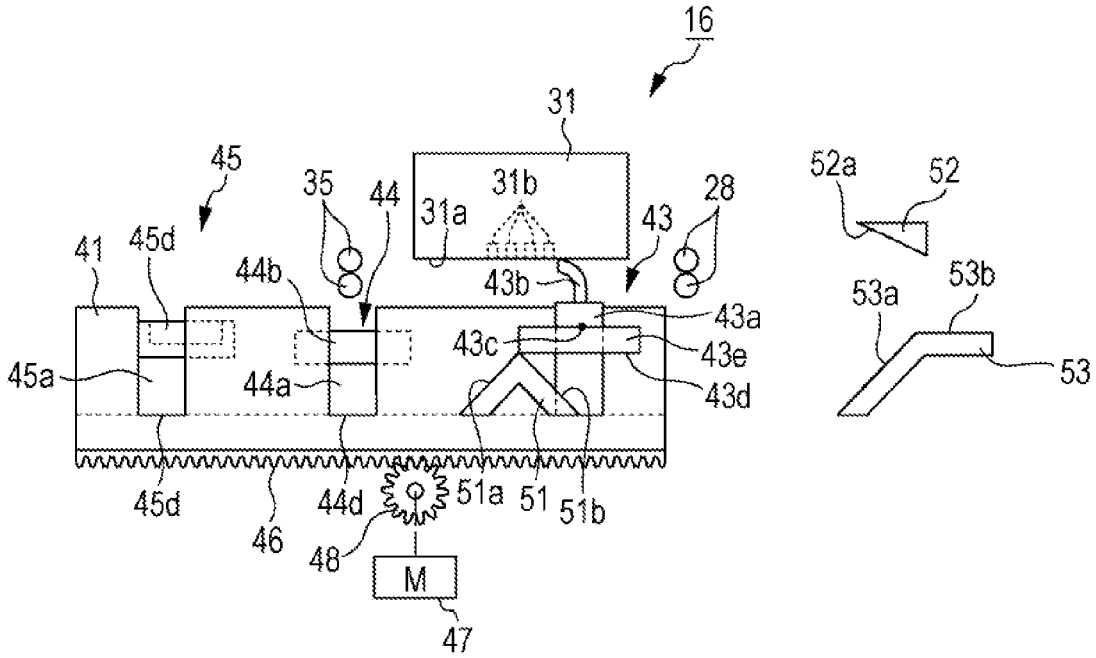
FIG. 7 is a schematic front view of the functional section when the wiper unit wipes the nozzle forming surface.

FIG. 7 illustrates a state where immediately before the wiping of the nozzle forming surface 31*a* is finished by the wiper unit 43. Then, when the tray 41 is moved further upstream from this state, now, the engagement surface 43*d* of the wiper unit 43 start to slide on the second cam surface 51*b* of the first cams 51 and the wiper unit 43 moves in a direction separating from the nozzle forming surface 31*a* of the recording head 31 relative to the tray 41.

Meanwhile, when the nozzle forming surface 31*a* of the recording head 31 is wiped by the wiper blade 43*b* included in the wiper unit 43, the ink attaches to the wiper blade 43*b*. If the ink is left without removing, since ink solvent evaporates and the ink is fixed on the wiper blade 43*b*, modulus of elasticity of the wiper blade 43*b* changes and wiping performance is degraded. Next, wiper cleaning is described in which ink is removed by abutting the wiper cleaner 52 to the wiper blade 43*b* in order to suppress the degradation of the wiping performance.

Since the wiper cleaning is performed by abutting the wiper blade 43*b* to the wiper cleaner 52, the tray 41 moves further upstream from the state being illustrated in FIG. 7 in order to engage the wiper unit 43 with the second cam 53. Then, the engagement surface 43*d* of the wiper unit 43 slides on the third cam surface 53*a* and the fourth cam surface 53*b* of the second cam 53 so that the wiper unit 43 moves in the direction approaching the abutting surface 52*a* of the wiper cleaner 52 relative to the tray 41 and the wiper blade 43*b* abuts the abutting surface 52*a*.

Figure 8:
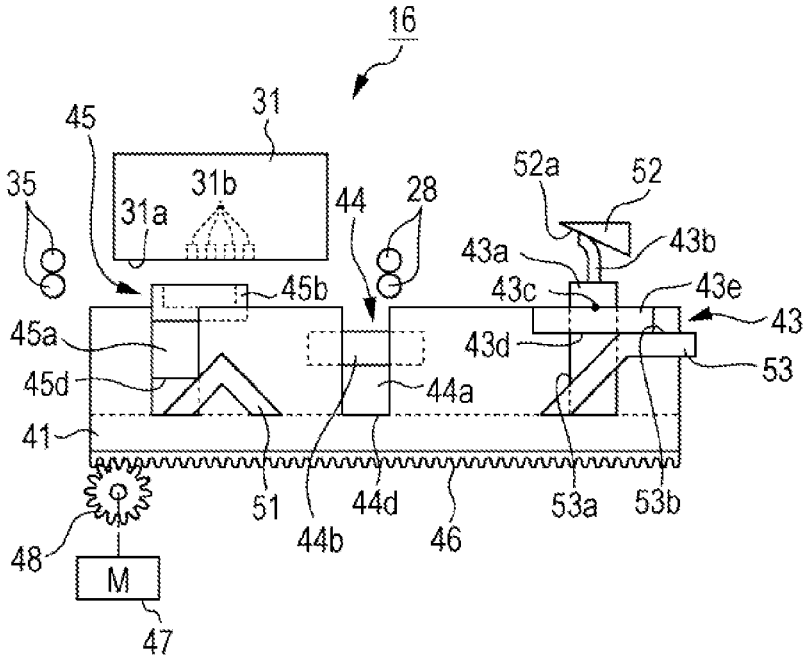
FIG. 8 is a schematic front view of the functional section when the wiper unit abuts a wiper cleaner.

FIG. 8 illustrates a state where the wiper blade 43*b* of the wiper unit 43 abuts the abutting surface 52*a* of the wiper cleaner 52. In this state, the ink attached to the wiper unit 43 is absorbed in the abutting surface 52*a*. In addition, the distance between the lower end of the wiper cleaner 52 and the top portion of the second cam 53 in an erection direction of the wiper blade 43*b* in the wiper unit 43 is shorter than the distance between the nozzle forming surface 31*a* and the top portion of the first cams 51. Thus, when the wiper blade 43*b* wipes the ink from the nozzle forming surface 31*a*, the portion thereof, which is wider than the portion sliding on the nozzle forming surface 31*a*, can abut the abutting surface 52*a* of the wiper cleaner 52.

Thus, when the wiping of the nozzle forming surface 31*a* is completed by the wiper unit 43, the support unit 44 is disposed on the position facing the recording head 31 illustrated in FIG. 3 and the recording can be performed by moving the tray 41 downstream.

Figure 9:
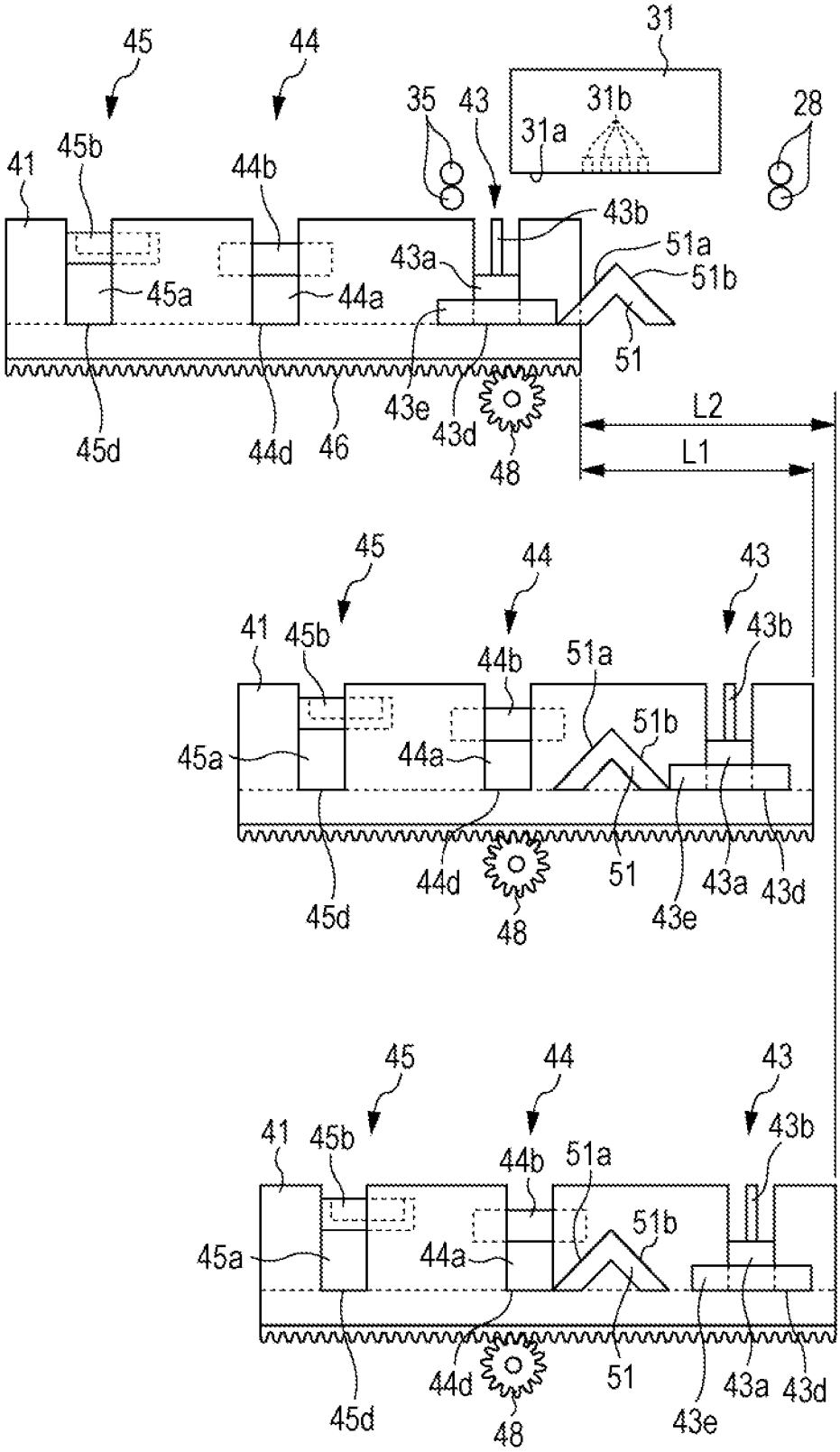
FIG. 9 is a schematic front view of the functional section illustrating a positional relationship between the wiper unit and the support unit.

In addition, as illustrated in FIG. 9, in the functional section 16 of the embodiment, a distance L2 in which the tray 41 is moved in a direction along the nozzle forming surface 31*a* from where the engagement of the wiper unit 43 with the first cams 51 is started to where the engagement of the support unit 44 with the first cams 51 is started is longer than a distance L1 in which the tray 41 is moved in a direction along the nozzle forming surface 31*a* from where the engagement of the wiper unit 43 with the first cams 51 is started to where the engagement thereof is finished. In addition, although not illustrated, the positional relationship between the support unit 44 and the cap unit 45 is similar relationship described above. Accordingly, interference between each of units 43 to 45 can be suppressed by moving each of units 43 to 45 in the direction approaching the nozzle forming surface 31*a*, without engaging the plurality of units 43 to 45 with the first cams 51 at the same time.

In addition, as illustrated in FIGS. 3, 4 and 6, respectively, although each of units 43 to 45 is in the closest state to the nozzle forming surface 31*a* of the recording head 31, the center-of-gravity positions 43*c* to 45*c* of the sliding shafts 43*a* to 45*a* of each of units 43 to 45 are positioned inside the guide groove 42 in the sliding direction of each of sliding shafts 43*a* to 45*a*. Accordingly, although when each of units 43 to 45 is disposed the closest to the nozzle forming surface 31*a*, the sliding shafts 43*a* to 45*a* of each of units 43 to 45 are not separated from the guide groove 42 of the tray 41.

According to the embodiment described above, the following advantage can be obtained.

(1) When the tray 41 supporting each of units 43 to 45 moves in a direction along the nozzle forming surface 31*a* of the recording head 31 due to the driving of the driving mechanism constituted of the rack 46, the pinion 48 and the driving motor 47, each of units 43 to 45 engages with the first cams 51, individually. Then, the unit engaged with the first cams 51 individually is displaced in the direction approaching and separating from the nozzle forming surface 31*a* so as to function with respect to the recording head 31. In other words, the tray 41 moves in the direction along the nozzle forming surface 31*a*, each of units 43 to 45 engages with the first cams 51 sequentially to be displaced and the units functioning with respect to the recording head 31 are switched sequentially. Accordingly, the unit functioning with respect to the recording head 31 in the plurality of units 43 to 45 including the units 43 and 45 maintaining the recording head 31 can be switched while suppressing increase in the size of the apparatus. In addition, one of the plurality of units 43 to 45 is selected and can be moved on the functioning position by the single driving motor 47 (a driving source). At the same time, the unit which is selected in the position described above can be moved in the direction approaching and separating from the nozzle forming surface 31*a* of the recording head 31.

(2) Since at least one of the wiper unit 43 and the cap unit 45 maintaining the recording head 31, and the support unit 44 having the support function of the paper P engage with the first cams 51 sequentially and are displaced while the tray 41 is moved, the units 43 to 45 functioning with respect to the recording head 31 can be simply switched.

(3) Desired units 43 to 45 can be displaced in the direction approaching and separating from the nozzle forming surface 31*a* without reciprocating the tray 41 in one direction (for example, from the downstream side to the upstream side), in other words, by moving the tray 41 only one direction.

(4) Although the units 43 to 45 engaging with the first cams 51 are in the closest state to the nozzle forming surface 31*a*, the center-of-gravity positions 43*c* to 45*c* in the sliding direction of the sliding shafts 43*a* to 45*a* which slide in the guide groove 42 of the tray 41 in each of units 43 to 45 to be displaced fall inside the guide groove 42. Thus, it is possible to suppress that each of units 43 to 45 is separated (the supporting state by the tray 41 is released) from the tray 41.

(5) Since the disposition order of the wiper unit 43, the support unit 44 and the cap unit 45 supported by the tray 41 can be freely selected, the degree of freedom in design can be increased. In addition, when the printer 11 is used, the disposition order of the wiper unit 43, the support unit 44 and the cap unit 45 supported by the tray 41 can be freely exchanged.

(6) Since other units do not engage with the first cams 51 in a state where one unit engages with the first cams 51, it is possible to suppress the interference each other by approaching the nozzle forming surface 31*a* while engaging the plurality of the units 43 to 45 with the first cams 51 together.

(7) The ink attached to the wiper unit 43 can be removed by approaching (abutting) the wiper cleaner 52 by the second cam 53 without leaving the ink attached to the wiper unit 43 (the wiper blade 43*b*) which wipes the nozzle forming surface 31*a* of the recording head 31. Accordingly, it is possible to suppress the degradation of the wiping performance of the wiper unit 43 due to fixing of the ink in the wiper unit 43.

(8) The distance between the lower end of the wiper cleaner 52 and the top portion of the second cam 53 in the erection direction of the wiper blade 43*b* in the wiper unit 43 is shorter than the distance between the nozzle forming surface 31*a* and the top portion of the first cams 51. Thus, the portion of the wiper blade 43*b* wider than the portion sliding on the nozzle forming surface 31*a* can abut the abutting surface 52*a* of the wiper cleaner 52 when the ink is wiped from the nozzle forming surface 31*a*. Accordingly, it is possible to suppress vitiation of the wiper cleaner 52 by absorbing the ink attached to the wiper blade 43*b*.

In addition, the embodiment described above may be changed to following other embodiments.

In the above embodiment, the printer 11 may further include an ink receiving section (a liquid receiving section) as the functional member maintaining the recording head 31, which receives the ink ejected from the nozzles 31*b* of the recording head 31 regardless of the recording.

In the above embodiment, the interval of the guide groove 42 formed on the tray 41 may be constant with respect to the moving direction of the tray 41.

In the above embodiment, the wiper cleaner 52 and the second cam 53 may be disposed downstream the recording head 31. In this case, in order to engage the second cam 53 only with the wiper unit 43, it is preferable that the engaging surface 43*d* of the wiper unit 43 and the second cam 53 be disposed on the position outside in the width direction of the paper P from the first cams 51.

In the above embodiment, the wiper blade 43*b* may be a cylindrical wiper of which the axial direction is the width direction of the paper P.

In the above embodiment, a plurality of the first cams 51 positioned corresponding to the recording head 31 may be provided so as to engage the units 43 to 45, individually.

In the above embodiment, the rack 46 and the pinion 48 constituting the driving mechanism may be replaced by a sprocket and chain, may be replaced by a belt and pulley and may be replaced by hydraulic and pneumatic cylinders or the like. The driving mechanism may be a driving mechanism which can be reciprocated by a single driving source.

In the above embodiment, the guide groove 42 formed on the tray 41 may be four or more. A plurality of units (for example, two support units 44 or the like) the same as a plurality of the guide grooves 42 may be provided.

In the above embodiment, the disposition order of each of units 43 to 45 may be freely changed.

In the above embodiment, the printer 11 may be a serial printer. In this case, it is preferable that the functional section 16 be provided at a home position that is a region outside the recording region.

In the above embodiment, the first cams 51 and the second cam 53 may be united as a single cam extending in the moving direction of the tray 41.

In the above embodiment, the first cams 51 having two cam surfaces 51*a* and 51*b* may have the cam surfaces more than two.

In the above embodiment, the interval between the nozzle forming surface 31*a* and the support stand 44*b* may be adjusted by adjusting the engagement position between the support unit 44 and the first cams 51 in the sliding direction of the sliding shaft 44*a* of the support unit 44.

In the above embodiment, each of the cams 51 and 53 may engage with only any one of units 43 to 45 by changing the position in the width direction of the paper P.

In the above embodiment, the wiper cleaner 52 may be omitted.

In the above embodiment, the recording head 31 may be movable in the thickness direction of the paper P. Therefore, each of units 43 to 45 moving vertically according to the moving direction of the tray 41 may abut or may do not abut the nozzle forming surface 31*a* of the recording head 31. For example, in the above embodiment, the wiping of the nozzle forming surface 31*a* by the wiper unit 43 can be limited to wipe only when the tray 41 moves from the downstream side to the upstream side.

In the above embodiment, each of cams 51 and 53 may be switched to be enabled (engagement) and disabled (non-engagement) with respect to each of units 43 to 45 included in the tray 41 according to the moving direction of the tray 41. Accordingly, each of units 43 to 45 can engage or disengage with the nozzle forming surface 31*a* of the recording head 31 according to the moving direction of the tray 41. For example, in the above embodiment, the wiping of the nozzle forming surface 31*a* by the wiper unit 43 can be limited to wipe only when the tray 41 moves from the downstream side to the upstream side.

In the above embodiment, the liquid ejecting apparatus is embodied as the printer 11 ejecting the ink as the liquid; however, the liquid ejecting apparatus may be embodied as a liquid ejecting apparatus ejecting or discharging liquid other than the ink. The invention may be applied to various types of liquid ejecting apparatuses including a liquid ejecting head or the like ejecting small amount of liquid droplets. In addition, liquid droplets is referred to as a state of the liquid ejected from the liquid ejecting apparatus described above and also includes liquids trailing in granular shape, a tear shape and a thread shape. In addition, the liquid referred to herein may be a material which can be ejected from the liquid ejecting apparatus. For example, a material may be used as long as the material is in the state of the liquid phase. In addition, the material includes liquid material having high or low viscosity, a flow-shape body such as sol, gel water, inorganic solvent, organic solvent, solution, liquid-shaped resin, liquid-shaped metal (melt metal), and not only the liquid as one state of a material but also a material in which particles of functional material consisted of solids such as pigments or metal particles is dissolved, dispersed or mixed in a solvent. In addition, a representative example of the liquid includes the ink described in the above embodiment, liquid crystal or the like. Here, the ink is intended to include various types of liquid compositions such as general water-based ink, oil-based ink, gel ink and hot melt ink. A specific example of the liquid ejecting apparatus includes, for example, a liquid ejecting apparatus ejecting liquid including in a form of dispersion or dissolution such as color material or electrode material that is used to manufacture a liquid crystal display, an EL (electroluminescence) display, a surface emitting display and color filter. Otherwise, the liquid ejecting apparatus may be a liquid ejecting apparatus ejecting a bioorganic material used for biochip manufacturing, a liquid ejecting apparatus ejecting liquid which is a sample used as a precision pipette, a printing apparatus, a micro-dispenser or the like. Furthermore, the liquid ejecting apparatus may employ a liquid ejecting apparatus ejecting lubricant at pin point to a precision machine such as a watch or a camera, a liquid ejecting apparatus ejecting transparent resin liquid such as an ultraviolet curing resin to form micro hemispherical lens (an optical lens) used for an optical communication device or the like on a substrate, and a liquid ejecting apparatus ejecting etching liquid such as acid or alkali to etch a substrate or the like. Then, the invention may be applied to any one of the liquid ejecting apparatuses.

The entire disclosure of Japanese Patent Application No. 2012-112214, filed May 16, 2012 is expressly incorporated by reference herein.

What is claimed is:

1. A liquid ejecting apparatus comprising:

a liquid ejecting head ejecting liquid from a nozzle formed on a nozzle forming surface onto a target being transported;

a moving body which moves in a direction along the nozzle forming surface, the moving body displaceably supporting a plurality of functional units in a direction approaching and separating from the nozzle forming surface, the plurality of functional units including at least one maintenance unit as a functional unit maintaining the liquid ejecting head and a support unit as a functional unit supporting the target being transported;

a driving mechanism which is driven when the moving body is moved; and a cam which is disposed on a moving path of the moving body and engages with at least two of the plurality of functional units, individually, supported on the moving body while the moving body moves in the direction along the nozzle forming surface, and makes the functional units to be displaced in the direction approaching and separating from the nozzle forming surface.

2. The liquid ejecting apparatus according to claim 1, wherein the maintenance units includes:

at least one of a wiper unit capable of wiping the liquid from the nozzle forming surface by sliding on the nozzle forming surface on which the liquid is attached and a cap unit capable of forming a closed space by abutting the liquid ejecting head so as to surround the nozzle.

3. The liquid ejecting apparatus according to claim 2, wherein the plurality of the functional units are the wiper unit, the support unit and the cap unit, and wherein the moving body supports the wiper unit, the support unit and the cap unit so that a disposition order engaging with the cam is provided in the order of the wiper unit, the support unit and the cap unit when the moving body moves in the direction along the nozzle forming surface.

4. The liquid ejecting apparatus according to claim 2 wherein the plurality of the functional units are the wiper unit, the support unit and the cap unit, and wherein the moving body supports the wiper unit, the support unit and the cap unit so that a disposition order engaging with the cam is provided in the order of the support unit, the cap unit and the wiper unit when the moving body moves in the direction along the nozzle forming surface.

5. The liquid ejecting apparatus according to claim 2 wherein the plurality of the functional units are the wiper unit, the support unit and the cap unit, and wherein the moving body supports the wiper unit, the support unit and the cap unit so that a disposition order engaging with the cam is provided in the order of the cap unit, the wiper unit and the support unit when the moving body moves in the direction along the nozzle forming surface.

6. The liquid ejecting apparatus according to claim 1, wherein the cam has:

a first cam surface which makes at least two functional units engaged with the cam to be displaced, individually, in the direction approaching to the nozzle forming surface, while the moving body moves in the direction along the nozzle forming surface, and a second cam surface which makes at least two functional units to be displaced, individually, in the direction separating from the nozzle forming surface.

7. The liquid ejecting apparatus according to claim 1, wherein a distance in which the moving body is moved from where the engagement of one of at least two of the functional units with the cam is started to where the engagement of the other of at least two of the functional units with the cam is started, is longer than a distance in which the moving body is moved from where the engagement of the one functional unit with the cam is started to where the engagement thereof is finished, when the moving body moves in the direction along the nozzle forming surface.

8. The liquid ejecting apparatus according to claim 1, wherein the moving body includes a guide groove which is moved when the functional unit is displaced in the direction approaching and separating from the nozzle forming surface, and wherein the functional unit is constituted such that a center-of-gravity position thereof in a sliding direction of a sliding section which slides in the guide groove is positioned inside the guide groove, in a state where the functional unit is the closest to the nozzle forming surface.

9. The liquid ejecting apparatus according to claim 1, wherein the plurality of the functional units includes the wiper unit capable of wiping the liquid from the nozzle forming surface by sliding on the nozzle forming surface on which the liquid is attached in the liquid ejecting head, and wherein when the cam is a first cam, the liquid ejecting apparatus further comprises:

a wiper cleaner which absorbs the liquid attached to the wiper unit by wiping the liquid ejecting head by the wiper unit, and a second cam which makes the wiper unit to be displaced in the direction approaching and separating from the wiper cleaner when the moving body moves in the direction along the nozzle forming surface.

10. A liquid ejecting apparatus comprising:

a liquid ejecting head ejecting liquid from a nozzle formed on a nozzle forming surface onto a target being transported in a transport direction;

a moving body which moves in the transport direction along the nozzle forming surface in a state where a plurality of functional members including a functional member maintaining the liquid ejecting head is displaceably supported in a direction approaching and separating from the nozzle forming surface;

a driving mechanism which is driven when the moving body is moved; and a cam which is disposed on a moving path of the moving body and engages with at least two of the plurality of the functional members, individually, supported on the moving body while the moving body moves in the transport direction along the nozzle forming surface, and makes the functional members to be displaced in the direction approaching and separating from the nozzle forming surface.

* * * * *